US011846051B2

(12) United States Patent
Lee

(10) Patent No.: US 11,846,051 B2
(45) Date of Patent: Dec. 19, 2023

(54) GHILLIE SUIT MANUFACTURING APPARATUS, GHILLIE SUIT MANUFACTURING METHOD, AND GHILLIE SUIT MANUFACTURED BY USING SAME

(71) Applicant: Jung Woong Lee, Seoul (KR)

(72) Inventor: Jung Woong Lee, Seoul (KR)

( * ) Notice: Subject to any disclaimer, the term of this patent is extended or adjusted under 35 U.S.C. 154(b) by 261 days.

(21) Appl. No.: 16/638,750

(22) PCT Filed: Aug. 14, 2018

(86) PCT No.: PCT/KR2018/009322
§ 371 (c)(1),
(2) Date: Feb. 13, 2020

(87) PCT Pub. No.: WO2019/035632
PCT Pub. Date: Feb. 21, 2019

(65) Prior Publication Data

US 2020/0237040 A1 Jul. 30, 2020

(30) Foreign Application Priority Data

Aug. 14, 2017 (KR) ..... 10-2017-0103174
May 25, 2018 (KR) ..... 10-2018-0059520

(51) Int. Cl.
*D04G 5/00* (2006.01)
*A41D 31/04* (2019.01)
(Continued)

(52) U.S. Cl.
CPC ..... *D04G 5/00* (2013.01); *A41D 3/00* (2013.01); *A41D 31/04* (2019.02); *A41H 42/00* (2013.01); *F41H 3/02* (2013.01)

(58) Field of Classification Search
CPC ..... D04G 5/00; D03D 41/00; D03D 41/01; D03D 39/18; D02G 3/42
See application file for complete search history.

(56) References Cited

U.S. PATENT DOCUMENTS 3,903,903 A * 9/1975 Matsumura ..... D05C 15/02 132/201
4,841,607 A * 6/1989 Sekino ..... D04G 5/00 28/160
(Continued)

FOREIGN PATENT DOCUMENTS

CN 203177734 U 9/2013
KR 10-2011-0004052 A 1/2011
(Continued)

OTHER PUBLICATIONS

International Search Report for PCT/KR2018/009322 dated Jan. 18, 2019 from Korean Intellectual Property Office.

*Primary Examiner* — Shaun R Hurley
(74) *Attorney, Agent, or Firm* — Howson & Howson LLP

(57) ABSTRACT

A ghillie suit manufacturing apparatus includes: a camouflage yarn feeding unit adapted to continuously feed camouflage yarns having different colors required for camouflage by a given distance from the left side to the right side and from the right side to the left side; a knotting unit adapted to tie the camouflage yarns fed from the camouflage yarn feeding unit on both side end portions of the camouflage yarns to form knots on both left and right sides of the camouflage yarns, while having given distances between the knots; and a cutting unit adapted to cut given portions of the camouflage yarns located between the knots formed on both left and right sides of the camouflage yarns by means of the knotting unit.

7 Claims, 12 Drawing Sheets

(51) Int. Cl.

| | |
|---|---|
| ***A41D 3/00*** | (2006.01) |
| ***A41H 42/00*** | (2006.01) |
| ***F41H 3/02*** | (2006.01) |

(56) References Cited

U.S. PATENT DOCUMENTS

| | | | | |
|---|---|---|---|---|
| 5,274,848 | A | 1/1994 | Shamblin | |
| 6,500,214 | B1 * | 12/2002 | Muirhead | F41H 3/00 8/518 |
| 6,851,126 | B1 * | 2/2005 | Humphreys | A41D 13/00 2/243.1 |
| 10,426,210 | B2 * | 10/2019 | Hong | A41G 3/0066 |
| 2018/0199649 | A1 | 7/2018 | Hong | |

FOREIGN PATENT DOCUMENTS

| | | | |
|---|---|---|---|
| KR | 10-2011-0041687 | A | 4/2011 |
| KR | 10-2017-0005599 | A | 1/2017 |

* cited by examiner

*Fig. 8*
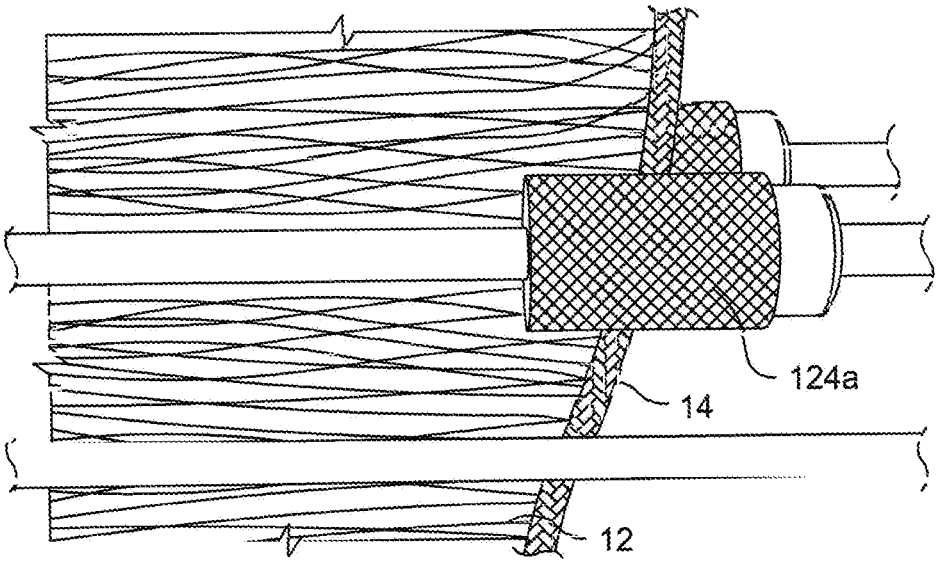
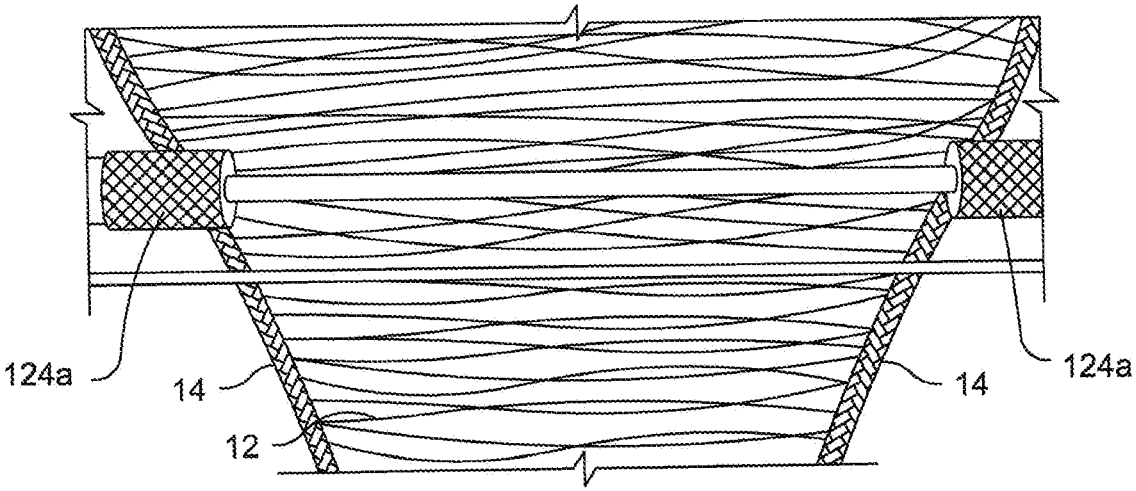
*Fig. 9*

GHILLIE SUIT MANUFACTURING APPARATUS, GHILLIE SUIT MANUFACTURING METHOD, AND GHILLIE SUIT MANUFACTURED BY USING SAME

TECHNICAL FIELD

The present invention relates to a ghillie suit manufacturing apparatus, a ghillie suit manufacturing method, and a ghillie suit manufactured by using same, and more particularly, to a ghillie suit manufacturing apparatus, a ghillie suit manufacturing method, and a ghillie suit manufactured by using same that are capable of feeding camouflage yarns having various colors for camouflage, forming knots on both ends of the camouflage yarns fed, while having predetermined distances between the knots, and cutting given portions of the camouflage yarns to manufacture the ghillie suit.

BACKGROUND ART

Generally, a ghillie suit is a type of camouflage clothing with materials like leaves attached thereto so as to protect or conceal a wearer like a sniper in a specific force who is in a mountain or forest from enemies.

The ghillie suit is made by attaching leaves to clothing so as to look like a part of a facing environment when viewed at the outside, according to the facing environment (e.g., a mountain or forest), and otherwise, the ghillie suit is made by detachably attaching various materials capable of protecting or concealing a wearer's body from enemies to clothing.

However, the existing ghillie suit is made by attaching leaves, nets or fabrics to clothing by means of an adhesive, thereby causing a manufacturing process to be very complicated and making a camouflage efficiency deteriorated because the attached parts are separated from the clothing.

One of the prior arts related to the ghillie suit is disclosed in Korean Patent Application Laid-open No. 10-2011-0004052 entitled "camouflage net suit", and the conventional camouflage net suit is made by attaching nets to clothing. So as to allow a wearer's body to look like the surrounding environment, camouflage items like branches, grass, and cloth pieces are located on the nets, thereby manufacturing the camouflage net suit for camouflage.

Especially, the conventional camouflage net suit requires a long time for the camouflage capable of allowing the net suit to look like the surrounding environment, and if the wearer moves or does any activities, the camouflage items may be detached from the net to make the camouflage efficiency deteriorated.

If a ghillie suit is used for a sniper, further, it is made by one by one sewing camouflage yarns manually on a military uniform or the outside of the military uniform, so that the ghillie suit can be prepared and used for a specific situation.

In case of the ghillie suit made manually, accordingly, the manufacturing time and cost are excessively increased, and as situations where the ghillie suits are used can be changed, various kinds of ghillie suits should be prepared appropriately.

Furthermore, as mentioned above, the conventional ghillie suit is made by sewing the camouflage yarns on a mesh fabric, so that while the ghillie suit is being worn, the camouflage yarns may be easily separated from the mesh fabric by means of external frictions or artificial forces pulling the camouflage yarns, thereby remarkably lowering the camouflage effects of the ghillie suit.

DISCLOSURE

Technical Problem

Accordingly, the present invention has been made in view of the above-mentioned problems occurring in the related art, and it is an object of the present invention to provide a ghillie suit manufacturing apparatus, a ghillie suit manufacturing method, and a ghillie suit manufactured by using same that are capable of feeding camouflage yarns having various colors for camouflage, forming knots on both ends of the camouflage yarns fed, while having predetermined distances between the knots, and cutting given portions of the camouflage yarns to manufacture the ghillie suit.

It is another object of the present invention to provide a ghillie suit that is capable of tying left and right sides of camouflage yarns to form knots by means of knot needles and sewing the knots on a mesh fabric thereof, thereby preventing the camouflage yarns from being separated from the mesh fabric thereof.

Technical Solution

To accomplish the above-mentioned objects, according to one aspect of the present invention, there is provided a ghillie suit manufacturing apparatus including: a camouflage yarn feeding unit adapted to continuously feed camouflage yarns having different colors required for camouflage by a given distance from the left side to the right side and from the right side to the left side; a knotting unit adapted to tie the camouflage yarns fed from the camouflage yarn feeding unit on both side end portions of the camouflage yarns to form knots on both left and right sides of the camouflage yarns, while having given distances between the knots; and a cutting unit adapted to cut given portions of the camouflage yarns located between the knots formed on both left and right sides of the camouflage yarns by means of the knotting unit.

The camouflage yarn feeding unit includes: a plurality of rolls disposed at an upper portion thereof to wind the camouflage yarns having different colors required for camouflage therearound; and a guide for collecting the camouflage yarns, if the camouflage yarns having different colors wound around the rolls are fed to a lower portion thereof, to continuously guide the camouflage yarns by the given distance from the left side to the right side and from the right side to the left side, the knotting unit includes: knot needles adapted to tie the camouflage yarns guided by the guide according to a given set method to form the knots on both left and right sides of the camouflage yarns; and a pair of discharge rollers adapted to press tops and undersides of the knots formed on the left and right sides of the camouflage yarns to discharge a camouflage member on which the knots are formed on both left and right sides of the camouflage yarns by means of the knot needles, and the cutting unit includes a cutting blade adapted to cut the given portions of the camouflage yarns located between the knots formed on the left and right sides of the camouflage yarns by means of the knotting unit to allow the camouflage member discharged by the pair of discharge rollers to be separated to left and right sides.

The knotting unit is configured to allow the knot needles to collect the camouflage yarns and to form the knots at a time and the knot needles are plurally located on both sides thereof in transfer directions of the camouflage yarns guided to sequentially lock the camouflage yarns guided thereonto to form the knots.

The cutting unit includes: a disc-shaped cutting blade rotating in place to cut the given portions of the camouflage yarns located between the knots of both left and right sides of the camouflage yarns; and disc-shaped left and right guide rotary blades located behind the cutting blade in such a manner as to be close to both sides of the cutting blade and rotating in place in the opposite direction to the rotating direction of the cutting blade, the guide rotary blades having saw blades formed along the outer peripheries thereof to guide the camouflage yarns, the saw blades being formed at given outward inclination angles to allow the camouflage yarns guided thereby to be tightly pulled toward the knots on the left and right sides of the camouflage yarns.

A distance between the cutting blade and the guide rotary blades is in a range of 1 to 3 cm.

The camouflage yarns have the colors having shadows and silhouettes capable of being hard to be recognized by an enemy, and the camouflage member is used as any one of a camouflage suit, a camouflage net, a camouflage muffler, a camouflage veil, and a camouflage fabric for firearms.

Each knot needle includes: a hook-shaped loop formed on the end portion thereof; and a latch adapted to open and close the hook-shaped loop, whereby the knot needles are ascended and descended to allow the latches to open and close the hook-shaped loops, so that the camouflage yarns are inserted into or drawn from the hook-shaped loops to form the knots.

To accomplish the above-mentioned objects, according to another aspect of the present invention, there is provided a ghillie suit manufacturing method including the steps of: the camouflage yarn feeding step of continuously feeding camouflage yarns having different colors required for camouflage by a given distance from the left side to the right side and from the right side to the left side; the knotting step of tying the camouflage yarns fed through the camouflage yarn feeding step on both side end portions of the camouflage yarns fed to form knots on both left and right sides of the camouflage yarns, while having given distances between the knots; and the cutting step of cutting given portions of the camouflage yarns located between the knots formed on both left and right sides of the camouflage yarns in such a manner as to allow the camouflage yarns to be separated to left and right sides, wherein at the camouflage yarn feeding step, the camouflage yarns are fed by means of a plurality of rolls adapted to wind the camouflage yarns having different colors required for camouflage therearound and a guide for collecting the camouflage yarns, if the camouflage yarns having different colors wound around the rolls are fed, to continuously guide the camouflage yarns by the given distance from the left side to the right side and from the right side to the left side; at the knotting step, the knots are formed by means of knot needles adapted to tie the camouflage yarns guided by the guide according to a given set method to form the knots on both left and right sides of the camouflage yarns and a pair of discharge rollers adapted to press tops and undersides of the knots formed on both left and right sides of the camouflage yarns to discharge a camouflage member on which the knots are formed on both left and right sides of the camouflage yarns by means of the knot needles; and at the cutting step, the camouflage yarns are cut by means of a disc-shaped cutting blade rotating in place to cut the given portions of the camouflage yarns located between the knots of both left and right sides of the camouflage yarns, disc-shaped left and right guide rotary blades located behind the cutting blade in such a manner as to be close to both sides of the cutting blade and rotating in place in the opposite direction to the rotating direction of the cutting blade, and saw blades formed along the outer peripheries of the guide rotary blades to guide the camouflage yarns in such a manner as to have given outward inclination angles to allow the camouflage yarns guided thereby to be tightly pulled toward the knots on both left and right sides of the camouflage yarns.

To accomplish the above-mentioned objects, according to yet another aspect of the present invention, there is provided a ghillie suit manufactured by the ghillie suit manufacturing method according to the present invention through the ghillie suit manufacturing apparatus according to the present invention, the ghillie suit including: camouflage yarns having different colors required for camouflage; and knots formed by tying end portions of the camouflage yarns to allow the end portions of the camouflage yarns to be fixed.

Advantageous Effects

According to the present invention, the ghillie suit manufacturing apparatus is configured to have the camouflage yarn feeding unit adapted to continuously feed the camouflage yarns having different colors required for camouflage by a given distance from the left side to the right side and from the right side to the left side, the knotting unit adapted to tie the camouflage yarns fed from the camouflage yarn feeding unit on both side end portions of the camouflage yarns to form knots on both left and right sides of the camouflage yarns, while having given distances between the knots, and the cutting unit adapted to cut the given portions of the camouflage yarns located between the knots formed on both left and right sides of the camouflage yarns by means of the knotting unit.

In addition, the ghillie suit manufacturing apparatus according to the present invention can manufacture an excellent quality of a ghillie suit at a low manufacturing cost in large quantities.

Further, the ghillie suit according to the present invention can tie the left and right sides of the camouflage yarns to form the knots by means of the knot needles and sew the knots on the mesh fabric thereof, thereby preventing the camouflage yarns from being separated from the mesh fabric thereof.

DESCRIPTION OF DRAWINGS

FIG. 8 is a drawing showing enlarged discharge rollers of the ghillie suit manufacturing apparatus according to the present invention.

FIG. 9 is a drawing showing an example where a camouflage member is discharged by the discharge rollers in the ghillie suit manufacturing apparatus according to the present invention.

BEST MODE FOR INVENTION

Figure 1:
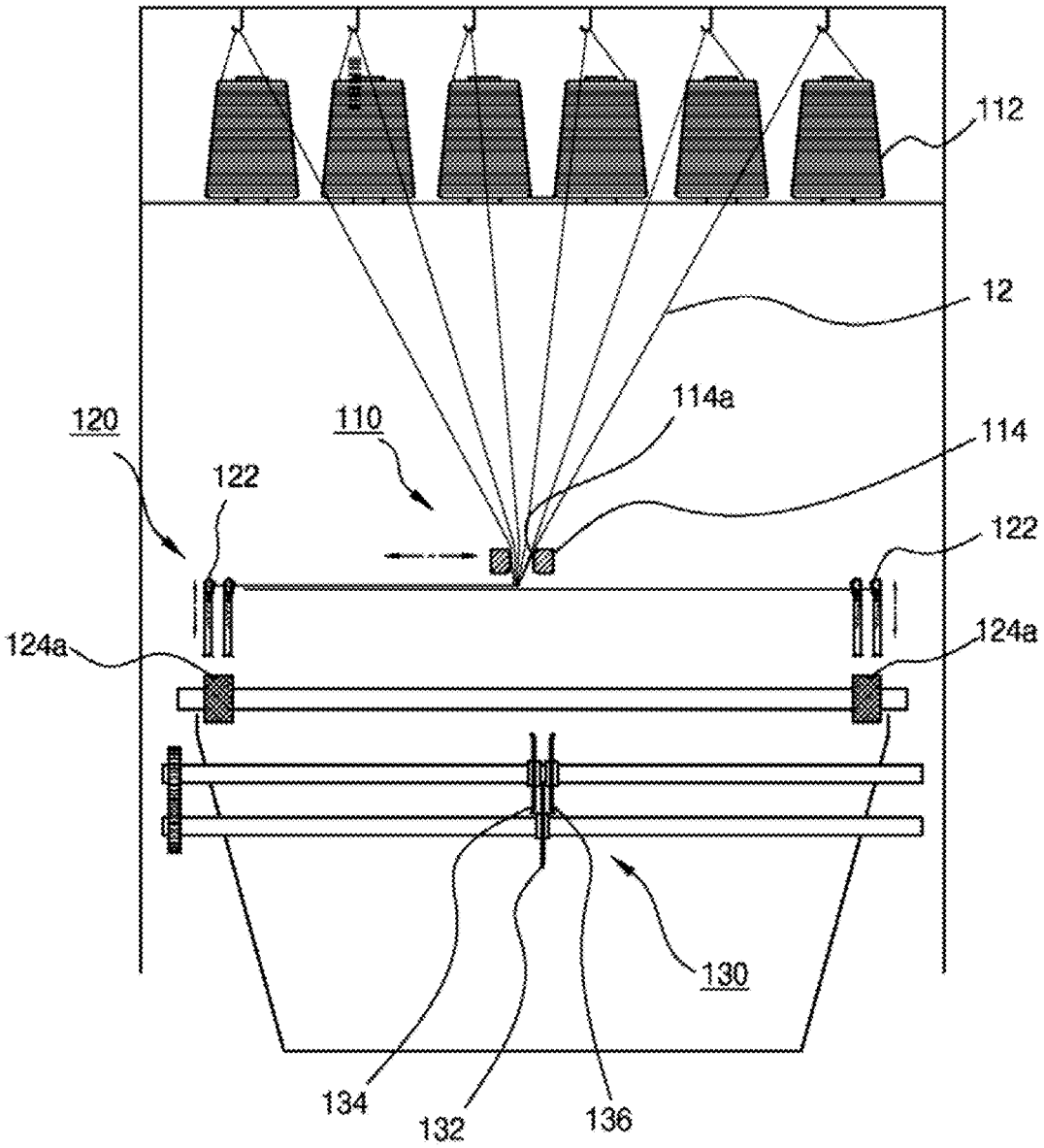
FIG. 1 is a schematic view showing a ghillie suit manufacturing apparatus according to the present invention.

The present invention relates to a ghillie suit manufacturing apparatus including: a camouflage yarn feeding unit adapted to continuously feed camouflage yarns having different colors required for camouflage by a given distance from the left side to the right side and from the right side to the left side; a knotting unit adapted to tie the camouflage yarns fed from the camouflage yarn feeding unit on both side end portions of the camouflage yarns to form knots on both left and right sides of the camouflage yarns, while having given distances between the knots; and a cutting unit adapted to cut given portions of the camouflage yarns located between the knots formed on both left and right sides of the camouflage yarns by means of the knotting unit, and to a ghillie suit manufacturing method and a ghillie suit manufactured by using same.

MODE FOR INVENTION

Hereinafter, an explanation on the present invention will be in detail given with reference to the attached drawings. The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

Figure 2:
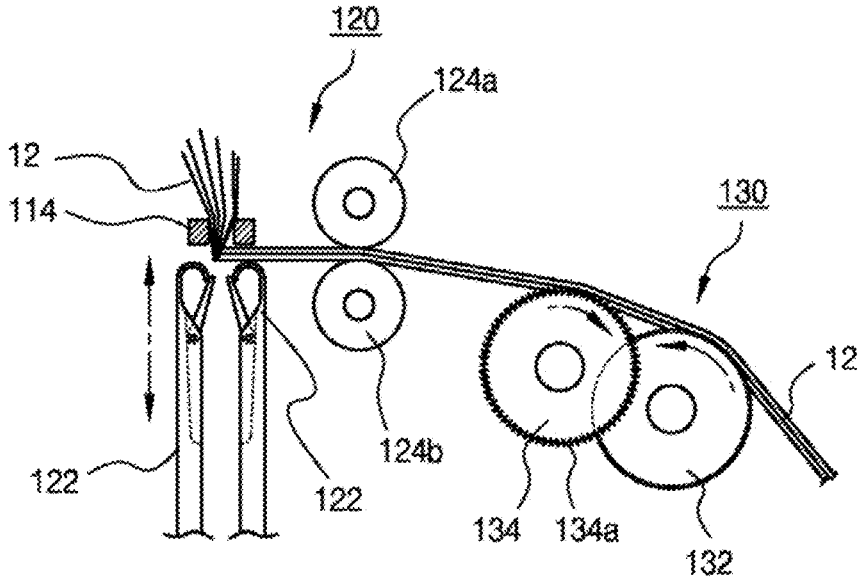
FIG. 2 is a schematic view showing a configuration of the ghillie suit manufacturing apparatus according to the present invention.
Figure 3:
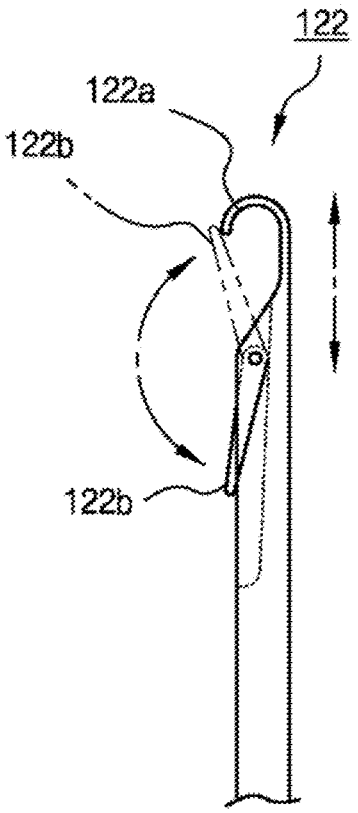
FIG. 3 is a side view showing an example of a knot needle for forming knots in the ghillie suit manufacturing apparatus according to the present invention.
Figure 4:
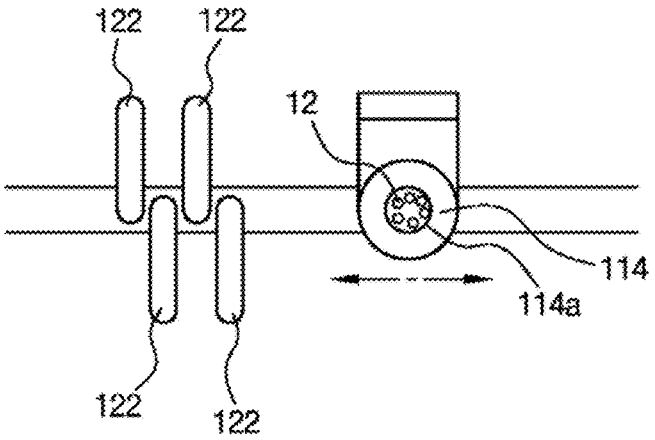
FIG. 4 is a schematic top view showing a guide for guiding camouflage yarns to left and right sides and the knot needles in the ghillie suit manufacturing apparatus according to the present invention.
Figure 5:
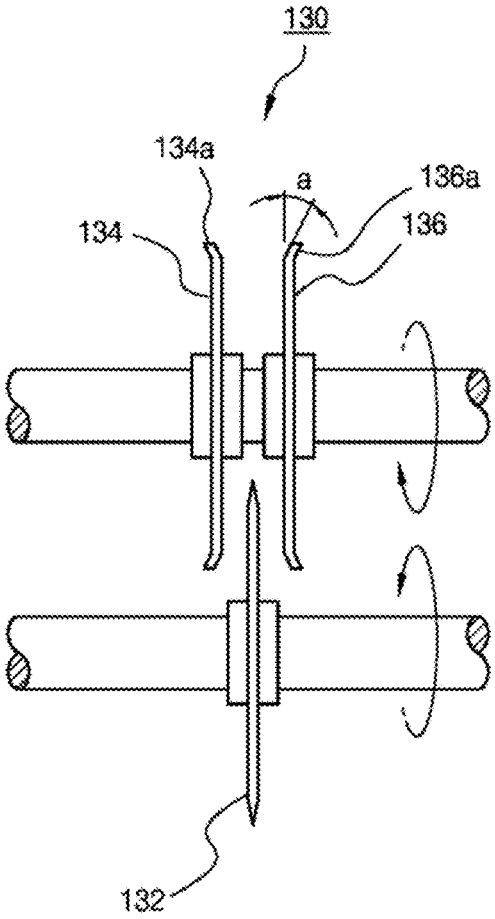
FIG. 5 is a schematic view showing a cutting unit in the ghillie suit manufacturing apparatus according to the present invention.
Figure 6:
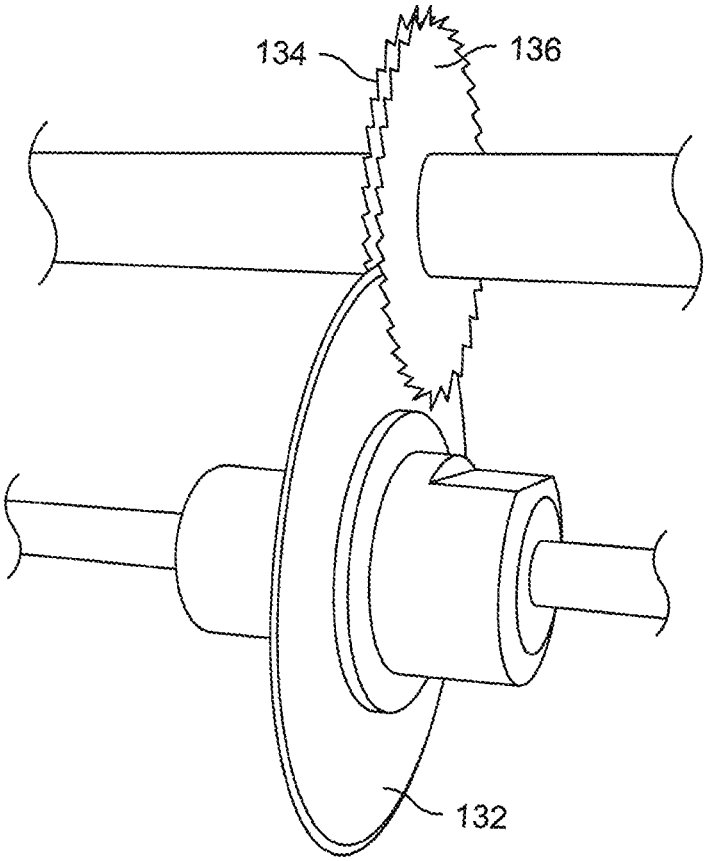
FIG. 6 is a drawing showing the cutting unit in the ghillie suit manufacturing apparatus according to the present invention.
Figure 7:
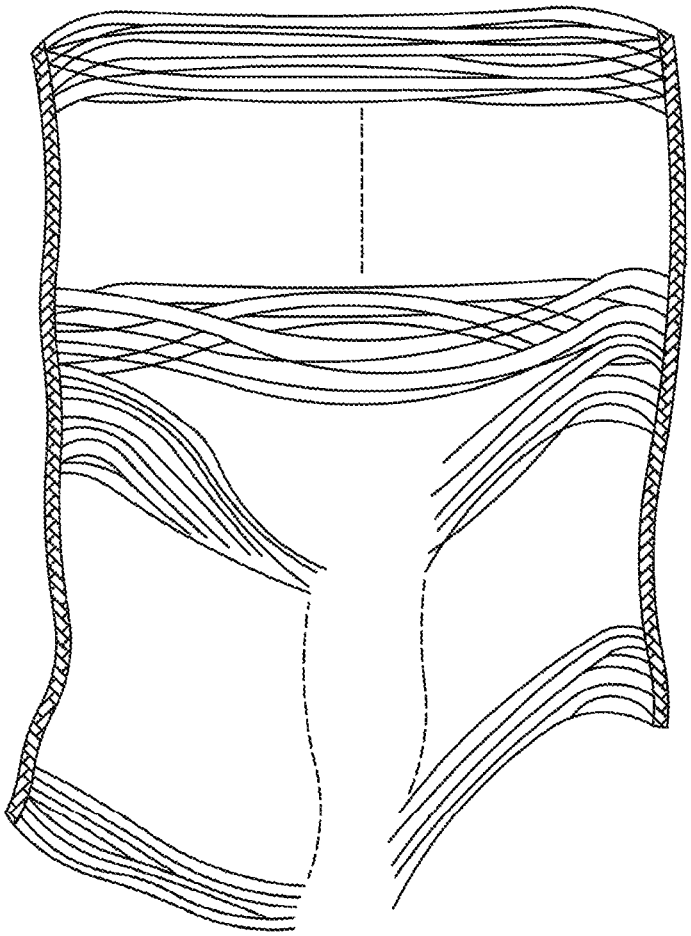
FIG. 7 is a drawing showing an example where the camouflage yarns are cut by the cutting unit in the ghillie suit manufacturing apparatus according to the present invention.
Figure 10:
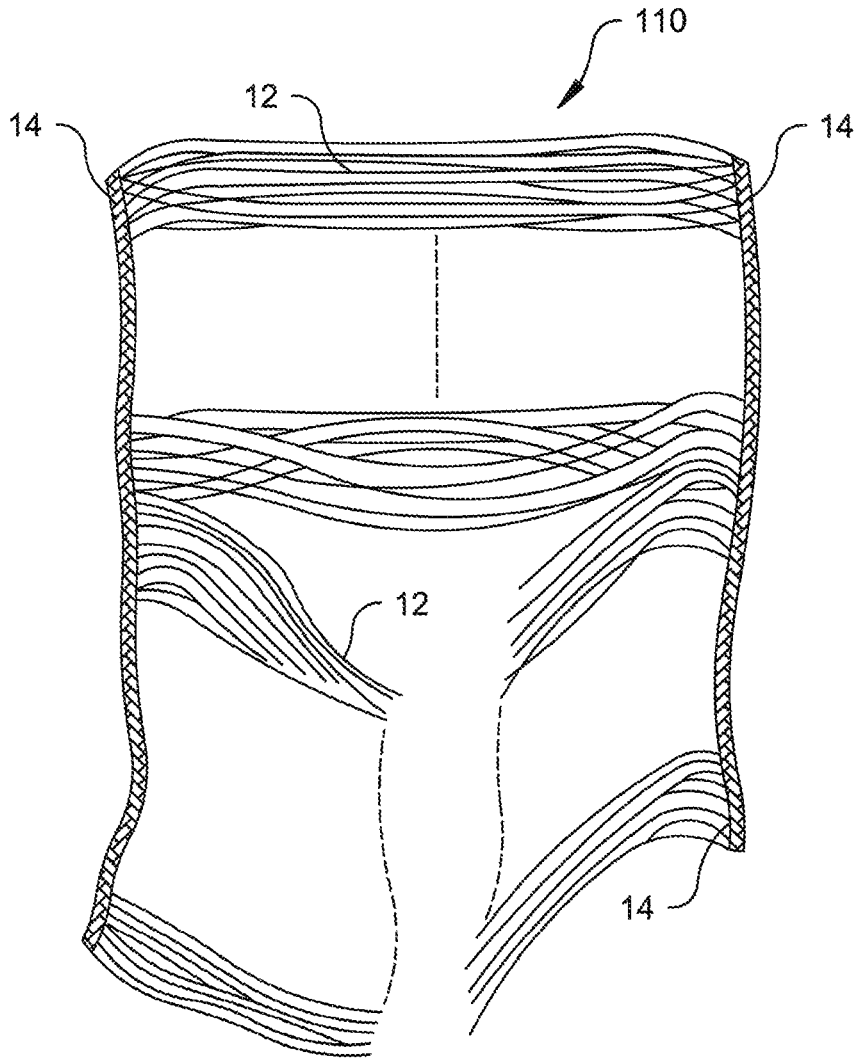
FIG. 10 is a drawing showing an example where given portions of the camouflage yarns are cut in the ghillie suit manufacturing apparatus according to the present invention.
Figure 11A:
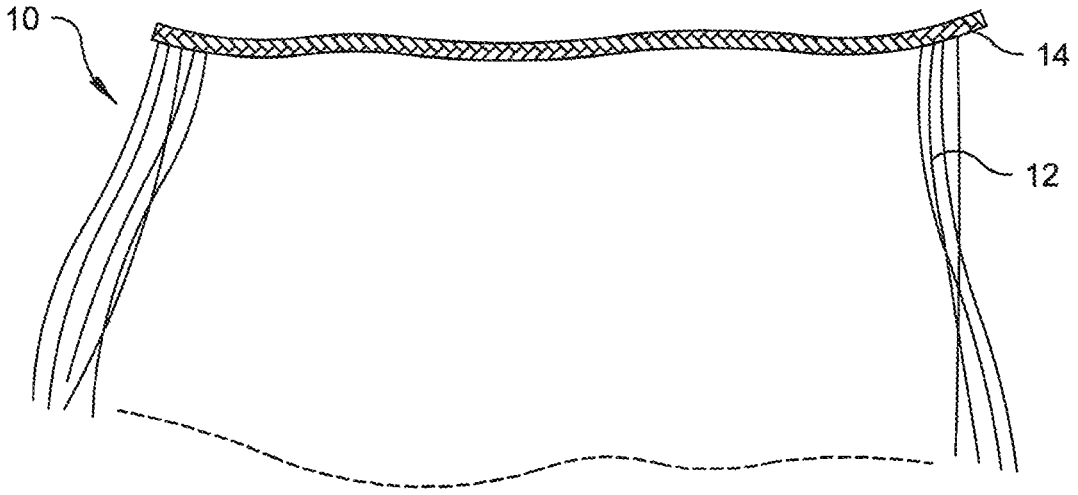
FIGS. 11A to 11C are drawings showing various examples of the camouflage members manufactured by the ghillie suit manufacturing apparatus according to the present invention.
Figure 11B:
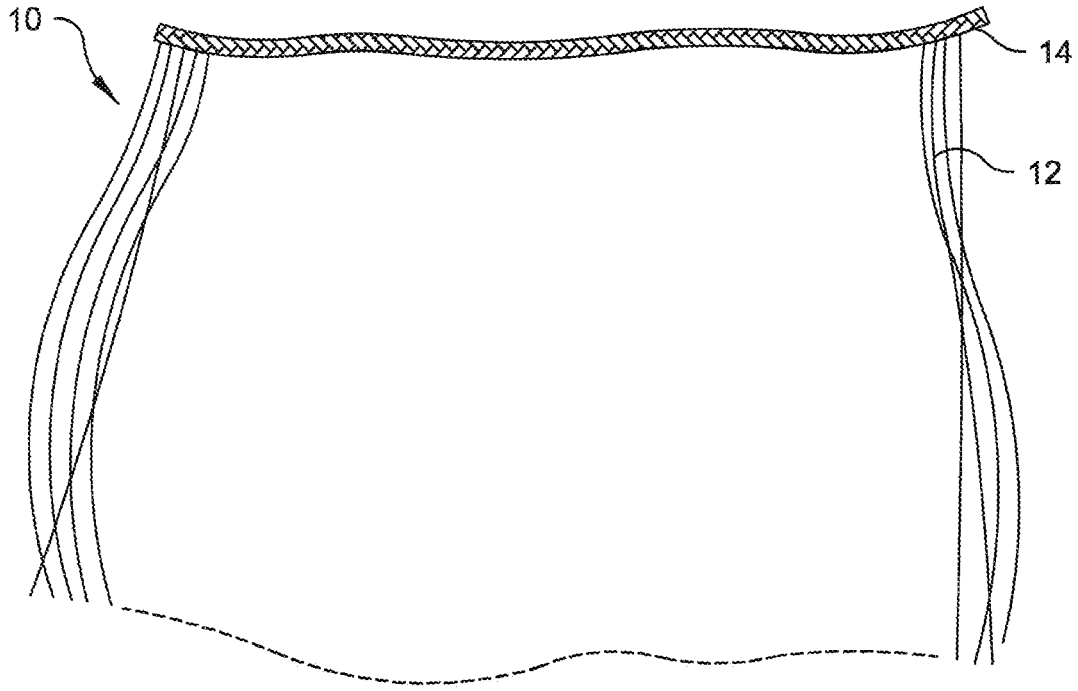
Figure 11C:
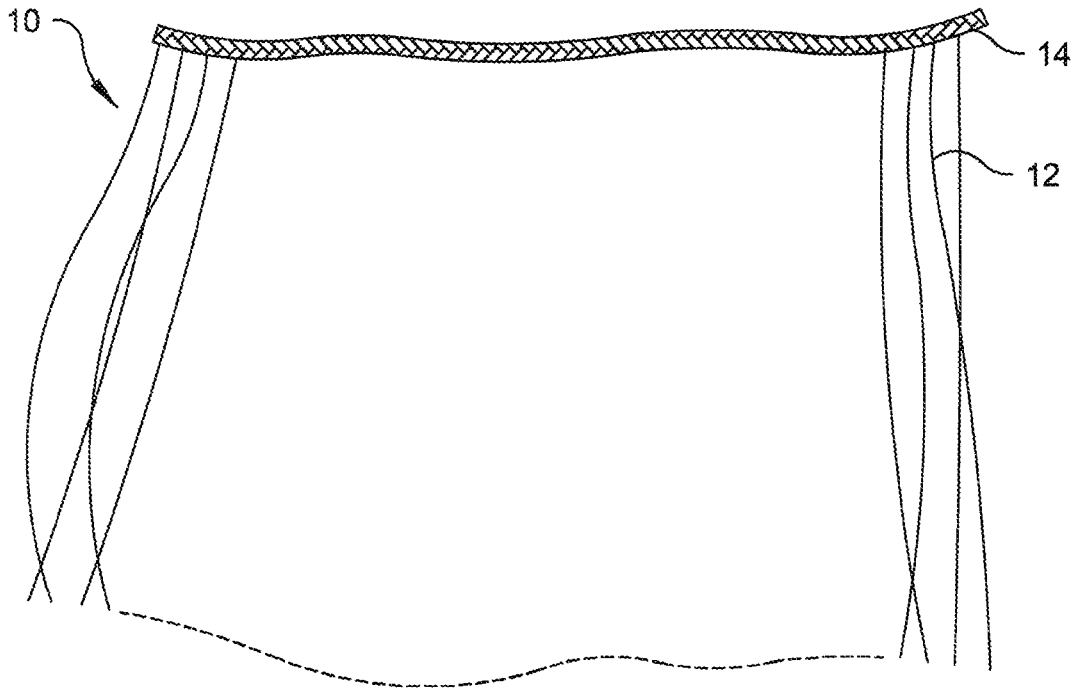
Figure 12:
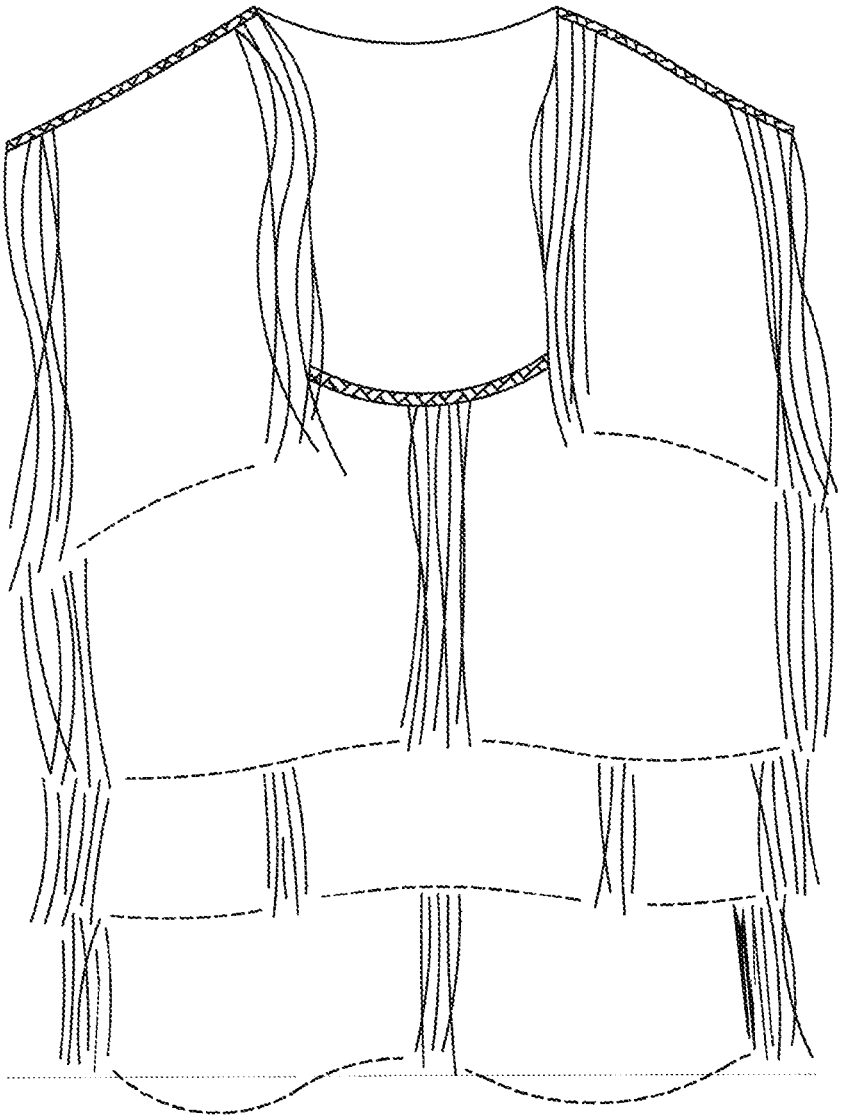
FIG. 12 is a drawing showing a ghillie suit's upper piece with the camouflage members manufactured by the ghillie suit manufacturing apparatus according to the present invention.
Figure 13:
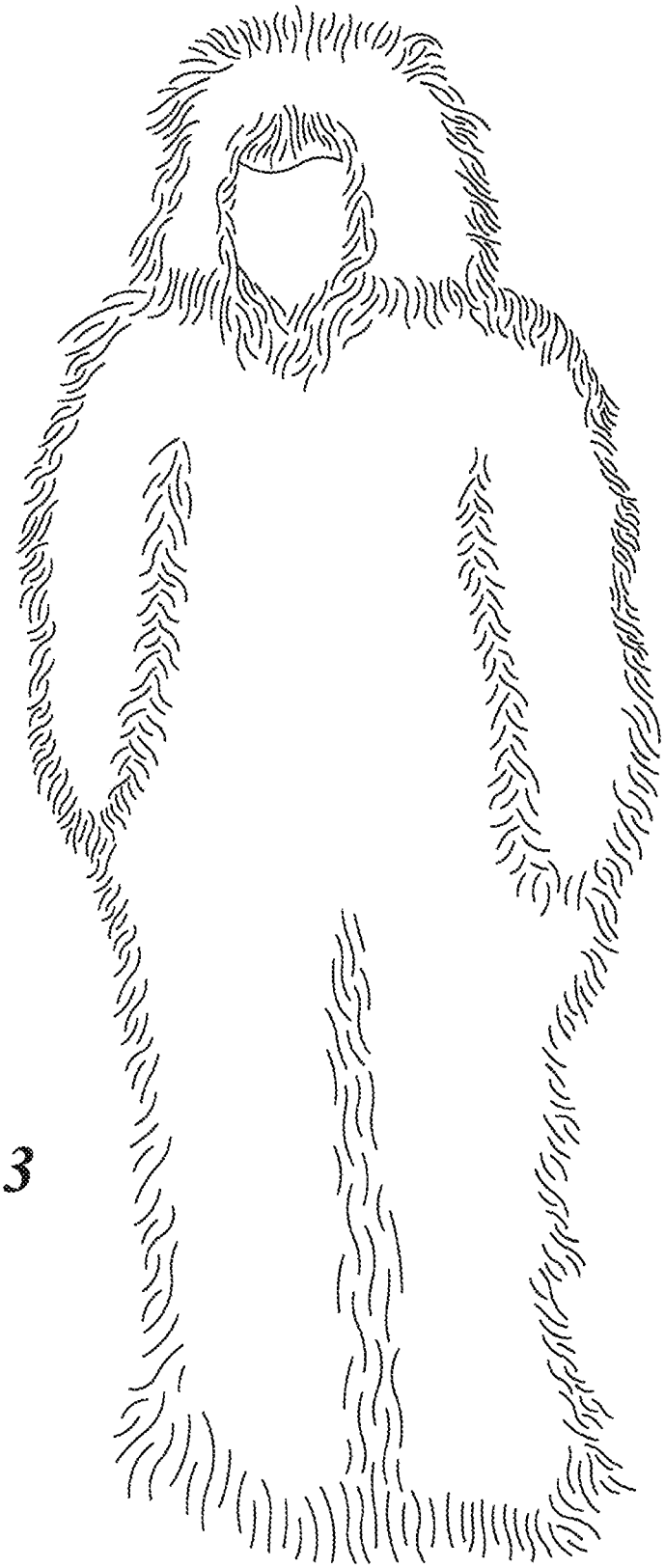
FIG. 13 is a drawing showing a worn state of the ghillie suit manufactured by the ghillie suit manufacturing apparatus according to the present invention.
Figure 14:
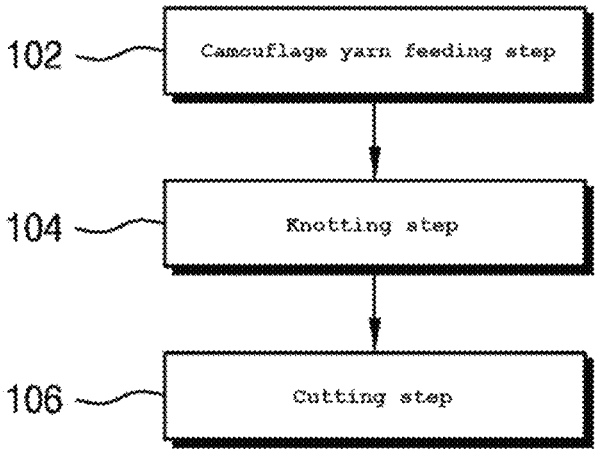
FIG. 14 is a flowchart showing a ghillie suit manufacturing method according to the present invention.

FIG. 1 is a schematic view showing a ghillie suit manufacturing apparatus according to the present invention, FIG. 2 is a schematic view showing a configuration of the ghillie suit manufacturing apparatus according to the present invention, FIG. 3 is a side view showing an example of a knot needle for forming knots in the ghillie suit manufacturing apparatus according to the present invention, FIG. 4 is a schematic top view showing a guide for guiding camouflage yarns to left and right sides and the knot needles in the ghillie suit manufacturing apparatus according to the present invention, FIG. 5 is a schematic view showing a cutting unit in the ghillie suit manufacturing apparatus according to the present invention, FIG. 6 is a drawing showing the cutting unit in the ghillie suit manufacturing apparatus according to the present invention, FIG. 7 is a drawing showing an example where the camouflage yarns are cut by the cutting unit in the ghillie suit manufacturing apparatus according to the present invention, FIG. 8 is a drawing showing enlarged discharge rollers of the ghillie suit manufacturing apparatus according to the present invention, FIG. 9 is a drawing showing an example where a camouflage member is discharged by the discharge rollers in the ghillie suit manufacturing apparatus according to the present invention, FIG. 10 is a drawing showing an example where given portions of the camouflage yarns are cut in the ghillie suit manufacturing apparatus according to the present invention, FIGS. 11A to 11C are drawings showing various examples of the camouflage members manufactured by the ghillie suit manufacturing apparatus according to the present invention, FIG. 12 is a drawing showing a ghillie suit's upper piece with the camouflage members manufactured by the ghillie suit manufacturing apparatus according to the present invention, FIG. 13 is a drawing showing a worn state of the ghillie suit manufactured by the ghillie suit manufacturing apparatus according to the present invention, and FIG. 14 is a flowchart showing a ghillie suit manufacturing method according to the present invention.

As shown, a ghillie suit manufacturing apparatus according to the present invention desirably has a camouflage yarn feeding unit 110.

The camouflage yarn feeding unit 110 serves to continuously feed camouflage yarns 12 having different colors required for camouflage by a given distance from the left side to the right side and from the right side to the left side.

In detail, the camouflage yarn feeding unit 110 has a plurality of rolls 112 disposed at an upper portion thereof to wind the camouflage yarns 12 having different colors required for camouflage therearound and a guide 114 for collecting the camouflage yarns 12, if the camouflage yarns 12 having different colors wound on the plurality of rolls 112 are fed to a lower portion thereof, to continuously guide the camouflage yarns 12 by the given distance from the left side to the right side and from the right side to the left side.

The guide 114 has a guide hole 114*a* through which the camouflage yarns 12 are collectedly passed and continuously fed by the given distance from the left side to the right side and from the right side to the left side.

The camouflage yarn feeding unit 110 is configured to feed and knit yarns like typical warp knitting machine, knitting machines, and so on, and therefore, a detailed explanation on the camouflage yarn feeding unit 110 will be avoided for the brevity of the description.

Further, the camouflage yarns 12 desirably have colors having shadows and silhouettes capable of being hard to be recognized by an enemy. In detail, the camouflage yarns 12 may have all colors similar to surrounding environments, without being particularly limited in color.

As shown, the ghillie suit manufacturing apparatus according to the present invention desirably has a knotting unit 120.

The knotting unit 120 serves to tie the camouflage yarns 12 fed from the camouflage yarn feeding unit 110 on both side end portions thereof to form knots 14 on both left and right sides of the camouflage yarns 12, while having given distances between the knots 14.

The knotting unit 120 has knot needles 122 adapted to tie the camouflage yarns 12 guided by the guide 114 according to a given set method to form the knots 14 on both left and right sides of the camouflage yarns 12.

At this time, the knot needles 122 are located on both left and right sides of the camouflage yarns 12 in such a manner as to be ascendedly and descendedly operated.

To do this, each knot needle 122 has a hook-shaped loop 122*a* formed on the end portion thereof and a latch 122*b* adapted to open and close the hook-shaped loop 122*a*.

The knot needles 122 are ascended and descended to allow the latches 122*b* to open and close the hook-shaped loops 122*a*, and accordingly, the camouflage yarns 12 are inserted into or drawn from the hook-shaped loops 122*a*, thereby forming the knots 14. The process of forming the knots 14 is carried out when raw yarns are knitted by the typical warp knitting machines, knitting machines, and so on, and therefore, a detailed explanation on the process of forming the knots will be avoided for the brevity of the description.

In detail, the camouflage yarns 12, which are reciprocally moved and fed from the left side to the right side and from the right side to the left side, are tied on the left and right sides of the camouflage yarns 12 by means of the knot needles 122 ascended and descended, so that the knots 14 are formed. If the knot needles 112 are ascended, that is, the latches 122*b* are open to allow the camouflage yarns 12 to be inserted into the hook-shaped loops 122*a*, and contrarily, if the knot needles 112 are descended, the latches 122*b* are closed to allow the camouflage yarns 12 to be knotted.

Particularly, distances of the knots 14 formed on both side end portions of the camouflage yarns 12 can be adjusted according to the positions of the knot needles 122. In detail, if a distance between both side knot needles 122 is long, the distances of the knots become long, and contrarily, if a distance between both side knot needles 122 is short, the distances of the knots become short.

According to the present invention, the knot needles 122 collect the camouflage yarns 12 to form the knots 14 at a time. If the camouflage yarns 12 having different colors are collectedly fed by the guide 114, in detail, the knot needles 122 form the knots of the camouflage yarns 12 at a time.

At this time, desirably, the plurality of knot needles 122 (generally, four to six needles) are located on both sides of the camouflage yarns 12 in transfer directions of the camouflage yarns 12 guided to sequentially lock the camouflage yarns 12 guided thereon, thereby forming the knots 14.

If the knots 14 are formed on both end portions of the camouflage yarns 12 by means of the knot needles 122, they are not easily loose advantageously. However, if the number of knot needles 122 is too large, the number of knots increases, so that the knots become too large. Accordingly, it is desirable to form an appropriate number of knots. That is, most desirably, four knot needles 122 are located to form four knots 14.

Further, the knotting unit 120 has a pair of discharge rollers 124*a* and 124*b* adapted to press tops and undersides of the knots 14 formed on both left and right sides of the camouflage yarns 12 to discharge a camouflage member 10 on which the knots 14 are formed on both left and right sides of the camouflage yarns 12 by means of the knot needles 122.

The pair of discharge rollers 124*a* and 124*b* is desirably rotated by means of a motor, a shaft, and a power transfer device, and such a configuration can be obtained through a typical power transfer structure.

As shown, the ghillie suit manufacturing apparatus according to the present invention desirably has a cutting unit 130.

The cutting unit 130 is located in front of the knotting unit 120 to cut given portions of the camouflage yarns 12 located between the knots 14 formed on both left and right sides of the camouflage yarns 12 by means of the knotting unit 120. In detail, the cutting unit 130 serves to cut the center of the camouflage member 10 discharged after the knots 14 are formed on both left and right sides of the camouflage yarns 12 by means of the knotting unit 120, so that the camouflage member 10 is separated to left and right sides to manufacture the ghillie suit.

The cutting unit 130 serves to cut the given portions of the camouflage yarns 12 located between the knots 14 formed on both left and right sides of the camouflage yarns 12 by means of the knotting unit 120 to allow the camouflage member 10 to be separated to left and right sides, and so as to cut the camouflage yarns 12 of the camouflage member 10 discharged by the pair of discharge rollers 124*a* and 124*b*, accordingly, the cutting unit 130 has a cutting blade 132.

At this time, the cutting blade 132 is desirably formed of a disc-shaped cutting blade rotating in place, and the cutting blade 132 is coupled to a rotary shaft so that it rotates.

In this case, the lengths of the camouflage yarns 12 separated to the left and right sides may be varied according to the position of the cutting blade 132. That is, the lengths of the left side camouflage yarns 12 and the lengths of the right side camouflage yarns 12 can be differently cut by changing the position of the cutting blade 132 coupled to the rotary shaft.

Further, the cutting unit 130 desirably has disc-shaped left and right guide rotary blades 134 and 136 located behind the cutting blade 132, and the guide rotary blades 134 and 136 are desirably located on left and right sides in such a manner as to be close to both sides of the cutting blade 132. In detail, the guide rotary blades 134 and 136 are desirably located behind the cutting blade 132 in such a manner as to allow their portions to be laid on the cutting blade 132.

At this time, a distance between the guide rotary blades 134 and 136 and the cutting blade 132 is desirably in a range of 1 to 3 cm.

The guide rotary blades 134 and 136 are coupled to rotary shafts so that they rotate, and desirably, further they rotate in place in the opposite direction to the rotating direction of the cutting blade 132.

Further, the guide rotary blades 134 and 136 desirably have saw blades 134*a* and 136*a* formed along the outer peripheries thereof to guide the camouflage yarns 12, and the saw blades 134*a* and 136*a* are formed at outward inclination angles of a to allow the camouflage yarns 12 guided thereby to be tightly pulled toward the knots formed on both left and right sides of the camouflage yarns 12.

As the camouflage yarns 12 of the camouflage member 10 discharged are pulled toward both side knots by means of the saw blades 134*a* and 136*a* having the inclination angles of a, accordingly, they can be easily cut by means of the rotation of the cutting blade 132.

When the camouflage yarns 12 are tightly pulled toward the left and right knots by means of the guide rotary blades 134 and 136, in detail, they are cut by means of the cutting blade 132, thereby preventing cutting failures from occurring.

In this case, desirably, the cutting blade 132 rotates at a high speed.

A ghillie suit manufacturing method according to the present invention includes the camouflage yarn feeding step (S102), the knotting step (S104) and the cutting step (S106).

In detail, the ghillie suit manufacturing method according to the present invention includes the camouflage yarn feeding step (S102) of continuously feeding camouflage yarns having different colors required for camouflage by a given distance from the left side to the right side and from the right side to the left side, the knotting step (S104) of tying the camouflage yarns fed through the camouflage yarn feeding step (S102) on both side end portions of the camouflage yarns fed to form knots on both left and right sides of the camouflage yarns, while having given distances between the knots, and the cutting step (S106) of cutting given portions of the camouflage yarns located between the knots formed on both left and right sides of the camouflage yarns in such a manner as to allow the camouflage yarns to be separated to left and right sides.

On the other hand, a ghillie suit manufactured using the ghillie suit manufacturing apparatus and method according to the present invention includes camouflage yarns 12 having different colors required for camouflage and a camouflage member 10 having knots 14 formed on end portions of the camouflage yarns 12.

In this case, the camouflage member 10 can be used as any one of a camouflage suit, a camouflage net, a camouflage muffler, a camouflage veil, and a camouflage cloth for firearms. In detail, the ghillie suit includes a top piece, a bottom piece, a hood, a camouflage fabric for firearms, and so on and has shadows and silhouettes capable of being hard to be recognized by an enemy. Particularly, the ghillie suit is used properly for a sniper. Further, the camouflage member 10 is used for items such as a hood, a towel, a shadow net, a mask, a neckerchief, a net, and equipment (guns) which require camouflage.

Under the above-mentioned configuration of the present invention, the knots are formed on the ends of the camouflage yarns so that the camouflage yarns can be fixedly provided, without any loss, thereby allowing the ghillie suit manufactured to have a life span longer than that in the existing product and advantageously permitting the ghillie suit to be machine-washable. Especially, the ghillie suit manufactured is lightweight, strong, and useable for a long term.

According to the present invention, the camouflage yarn feeding unit 110 serves to wind and feed the camouflage yarns having different colors required for camouflage.

The knotting unit 120 has the knot needles 122 located at given distances so as to tie the camouflage yarns fed to form knots according to a given set method.

Further, the knot needles 122 can be adjusted in distance as they are moved to the left and right sides, and the number of camouflage yarns can be freely increased or decreased.

Like this, the knotting of the camouflage yarns, the adjustment of the distances of the knot needles 122, and the control of the number of camouflage yarns may be carried out by means of a control box as a controller according to a consumer's desired request.

According to the present invention, therefore, the left and right sides of the camouflage yarns are tied to form the knots by means of the knot needles, and the knots are sewn on the mesh fabric of the ghillie suit, thereby preventing the camouflage yarns from being separated from the mesh fabric of the ghillie suit.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The present invention relates to the ghillie suit manufacturing apparatus, the ghillie suit manufacturing method, and the ghillie suit manufactured by using same that are capable of feeding the camouflage yarns having various colors for camouflage, forming the knots on both ends of the camouflage yarns fed, while having the predetermined distances between the knots, and cutting the given portions of the camouflage yarns to manufacture the ghillie suit.

The invention claimed is:

1. An apparatus for manufacturing camouflage members for use in a ghillie suit, the apparatus comprising:

a camouflage yarn feeding unit adapted to continuously feed camouflage yarns having different colors required for camouflage by a given distance from the left side to the right side and from the right side to the left side;

a knotting unit adapted to tie the camouflage yarns fed from the camouflage yarn feeding unit on both side end portions of the camouflage yarns to form knots on both left and right sides of the camouflage yarns, while having given distances between the knots; and a cutting unit adapted to cut given portions of the camouflage yarns located between the knots formed on both left and right sides of the camouflage yarns by means of the knotting unit.

2. The apparatus according to claim 1, wherein the camouflage yarn feeding unit comprises:

a plurality of rolls disposed at an upper portion thereof to wind the camouflage yarns having different colors required for camouflage therearound; and a guide for collecting the camouflage yarns, if the camouflage yarns having different colors wound around the rolls are fed to a lower portion thereof, to continuously guide the camouflage yarns by the given distance from the left side to the right side and from the right side to the left side, the knotting unit comprises:

knot needles adapted to tie the camouflage yarns guided by the guide according to a given set method to form the knots on both left and right sides of the camouflage yarns; and a pair of discharge rollers adapted to press tops and undersides of the knots formed on the left and right sides of the camouflage yarns to discharge a camouflage member on which the knots are formed on both left and right sides of the camouflage yarns by means of the knot needles, and the cutting unit comprises a cutting blade adapted to cut the given portions of the camouflage yarns located between the knots formed on the left and right sides of the camouflage yarns by means of the knotting unit to allow the camouflage member discharged by the pair of discharge rollers to be separated to left and right sides.

3. The apparatus according to claim 2, wherein the knotting unit is configured to allow the knot needles to collect the camouflage yarns and to form the knots at a time and the knot needles are plurally located on both sides thereof in transfer directions of the camouflage yarns guided to sequentially lock the camouflage yarns guided thereonto to form the knots.

4. The apparatus according to claim 1, wherein the cutting unit comprises:

a disc-shaped cutting blade rotating in place to cut the given portions of the camouflage yarns located between the knots of the left and right sides of the camouflage yarns; and disc-shaped left and right guide rotary blades located behind the cutting blade in such a manner as to be close to both sides of the cutting blade and rotating in place in the opposite direction to the rotating direction of the cutting blade, the guide rotary blades having saw blades formed along the outer peripheries thereof to guide the camouflage yarns, the saw blades being formed at a given outward inclination angle to allow the camouflage yarns guided thereby to be tightly pulled toward the knots on the left and right sides thereof.

5. The apparatus according to claim 4, wherein a distance between the cutting blade and the guide rotary blades is in a range of 1 to 3 cm.

6. The apparatus according to claim 2, wherein each knot needle comprises: a hook-shaped loop formed on the end portion thereof; and a latch adapted to open and close the hook-shaped loop, whereby the knot needles are ascended and descended to allow the latches to open and close the hook-shaped loops, so that the camouflage yarns are inserted into or drawn from the hook-shaped loops to form the knots.

7. A method for manufacturing camouflage members for use in a ghillie suit, the method comprising:

a camouflage yarn feeding step of continuously feeding camouflage yarns having different colors required for camouflage by a given distance from the left side to the right side and from the right side to the left side;

a knotting step of tying the camouflage yarns fed through the camouflage yarn feeding step on both side end portions of the camouflage yarns fed to form knots on both left and right sides of the camouflage yarns, while having given distances between the knots; and a cutting step of cutting given portions of the camouflage yarns located between the knots formed on both left and right sides of the camouflage yarns in such a manner as to allow the camouflage yarns to be separated to left and right sides, wherein at the camouflage yarn feeding step, the camouflage yarns are fed by means of a plurality of rolls adapted to wind the camouflage yarns having different colors required for camouflage therearound and a guide for collecting the camouflage yarns, if the camouflage yarns having different colors wound around the rolls are fed, to continuously guide the camouflage yarns by the given distance from the left side to the right side and from the right side to the left side;

at the knotting step, the knots are formed by means of knot needles adapted to tie the camouflage yarns guided by the guide according to a given set method to form the knots on both left and right sides of the camouflage yarns and a pair of discharge rollers adapted to press tops and undersides of the knots formed on both left and right sides of the camouflage yarns to discharge a camouflage member on which the knots are formed on both left and right sides of the camouflage yarns by means of the knot needles; and at the cutting step, the camouflage yarns are cut by means of a disc-shaped cutting blade rotating in place to cut the given portions of the camouflage yarns located between the knots of both left and right sides of the camouflage yarns, disc-shaped left and right guide rotary blades located behind the cutting blade in such a manner as to be close to both sides of the cutting blade and rotating in place in the opposite direction to the rotating direction of the cutting blade, and saw blades formed along the outer peripheries of the guide rotary blades to guide the camouflage yarns in such a manner as to have given outward inclination angles to allow the camouflage yarns guided thereby to be tightly pulled toward the knots on both left and right sides of the camouflage yarns.

* * * * *